US006298904B2

(12) United States Patent
Polich

(10) Patent No.: US 6,298,904 B2
(45) **Date of Patent: *Oct. 9, 2001**

(54) VENT-FORMING APPARATUS FOR METAL CASTING AND METHOD

(76) Inventor: Richard F. Polich, 39 Lakeview Trail, Salisbury Mills, NY (US) 12577

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/179,535

(22) Filed: Oct. 27, 1998

(51) Int. Cl.[7] ..... B22C 23/00; B22C 7/02; B22C 9/00

(52) U.S. Cl. ..... 164/410; 164/246; 164/361; 164/516; 164/34; 164/35; 164/45

(58) Field of Search ..... 164/516, 361, 164/34, 35, 45, 246, 410

(56) References Cited

U.S. PATENT DOCUMENTS 4,651,799 * 6/1989 Chandley ..... 164/45

4,842,037 * 6/1989 Brown et al. ..... 164/34

FOREIGN PATENT DOCUMENTS 56-56756 * 5/1981 (JP) .

* cited by examiner

*Primary Examiner*—Tom Dunn
*Assistant Examiner*—Kevin P. Kerns
(74) *Attorney, Agent, or Firm*—Fish & Neave; Jeffrey H. Ingerman

(57) ABSTRACT

A vent-forming apparatus for use in metal casting comprises a gas-permeable membrane with a lead-in tube attached to one surface and a breather tube attached to the opposite surface. The vent-forming apparatus may be used to create independent vents in the walls of shell-type molds used in the ceramic shell casting process for lost wax casting of ferrous and non-ferrous alloys. These vents exhaust gasses in the mold cavity to the atmosphere. The vent-forming apparatus also may be used in solid mold investment casting methods or in any other casting method in which venting is desirable or necessary.

28 Claims, 6 Drawing Sheets

VENT-FORMING APPARATUS FOR METAL CASTING AND METHOD

BACKGROUND OF THE INVENTION

This invention relates to a vent-forming apparatus and methods of using it in metal casting applications.

To make high quality metal castings, one conventional method is the ceramic shell casting process for lost wax casting of ferrous and nonferrous alloys such as steel, aluminum and bronze. According to this casting process, a ceramic shell-type mold is first constructed.

To construct such a shell-type mold, a pattern of the object to be cast in metal is first made from wax, plastic or other soluble, fusible or combustible material. This pattern of the object to be cast in metal is attached to a pattern of a system of ingates, down sprues or runners, and pouring basins. The pattern of the system of ingates, down sprues or runners, and pouring basins is made from wax, plastic or other soluble, fusible or combustible material. Pouring basins, down sprues or runners, and ingates ultimately are used to introduce molten metal into the mold cavity.

The pattern of the object to be cast and the pattern of the system of ingates, down sprues or runners, and pouring basins are coated with multiple layers of ceramic slurry and one or more silica refractory powders or other refractory powers. Silica and other refractory powders are commonly referred to as stuccos. Application of upwards of 30 or more layers is known in the art.

Once the ceramic slurry and stucco layers have dried adequately, a dewax and burn-out cycle is conducted. During the dewax and burn-out cycle, all of the patterns are dissolved, melted or burned away.

Completion of the dewax and burn-out cycle results in a shell-type mold having a hollow space in the form of the object to be cast in metal. This hollow space is commonly referred to as the mold cavity. Completion of the dewax and burn-out cycle also produces the cavities called ingates, down sprues or runners, and pouring basins in the shell-type mold. The mold cavity connects to the ingates, and down sprues or runners which in turn are connected to the pouring basins. Molten metal is introduced into the mold cavity via the pouring basins and the down sprues, runners and ingates.

Molten metal is introduced into the mold cavity in order to cast the desired object. Once the molten metal has solidified sufficiently, the mold is broken or torn away from the cast metal object and discarded. The molds typically cannot be reused.

Shell-type molds used in the ceramic shell casting process typically are refractory molds having only slight gas permeability. These shell-type molds suffer a functional disadvantage resulting from the fact that the mold walls have only slight gas permeability. This characteristically low gas permeability often prevents the mold cavity from adequately filling out with molten metal in heavily detailed sections and in sections having large surface areas relative to volume (i.e., thin-walled sections). This is because during the casting process, gasses trapped in these sections of the mold cavity cannot pass through the low permeability mold walls before the molten metal solidifies. As a result, the finished cast metal object exhibits non-fill defects.

Attempts at solving this fill-out problem include extension of the molten life of the metal by increasing the temperature of the shell-type mold and by increasing the pouring temperature of the molten metal. This approach is not entirely satisfactory as it can result in finished cast objects having coarse, porous structures and gross cracking.

Other attempts at solving this fill-out problem have involved mechanisms for increasing the gas permeability of the shell-type mold walls. Such increases in gas permeability have been achieved by the creation of voids and pores in the shell-type mold walls. These voids and pores in the shell-type mold walls act as conduits to pass gasses out of the mold cavity through the mold walls. However, increasing gas permeability in this manner has drawbacks. If the voids or pores become too large, molten metal will penetrate the mold walls and cause the finished cast object to have an undesirably rough surface. Faced with the possibility of such surface roughness, metal casters often choose to forego this approach.

Instead, some metal casters incorporate venting systems into the shell-type molds. These venting systems typically involve arrays of interconnected vent channels that pass through the shell-type mold walls. These vent channel arrays are located so as to connect hard-to-fill areas of the mold cavity to the atmosphere.

The vent channel arrays are formed in the walls of the shell-type mold as part of the mold making process. Typically, patterns of vent channel arrays are fashioned from wax, plastic or other soluble, fusible or combustible material. Normally, a similar material is used to make the pattern of the object to be cast. These vent channel array patterns are attached, in desired areas, to the pattern of the object to be cast. The pattern of the object to be cast, including the attached vent channel array patterns, and the patterns of the ingates, pouring basins and down sprues or runners are coated with layers of ceramic slurry and stucco to make the shell-type mold as described above.

Openings are cut in desired areas of the mold walls to expose the vent channel array patterns to the atmosphere prior to the dewax and burn-out cycle described above. During the dewax and burn-out cycle, all of the patterns are dissolved, melted or burned away. This results in a shell-type mold having a mold cavity, ingates, pouring basins, down sprues or runners and having walls that are infiltrated by arrays of interconnected vent channels connecting the mold cavity to the atmosphere. As an alternative, the openings to the atmosphere also may be made following the dewax and burn-out cycle, in which case the vent channel arrays themselves are exposed to the atmosphere after the dewax and burn-out cycle. However, it is more desirable to make the openings to the atmosphere prior to the dewax and burn-out cycle because the dissolved, melted or burned materials can run out of the openings to the atmosphere.

The vent channel arrays also may connect to the patterns for the ingates, pouring basins, and down sprues or runners in order to create vents to the atmosphere. In such case, the vents created exhaust gasses to the atmosphere through the ingates, down sprues, runners and pouring basin.

This known venting method is less than optimal because it involves construction, as part of the mold making process, of patterns of awkward and fragile interconnected vent channel arrays made of wax, plastic or other soluble, fusible or combustible materials. Such vent channel array patterns are often damaged or broken during the mold making process when the pattern of the object to be cast in metal, including the attached vent channel array patterns, is dipped into viscous ceramic slurries or turbulent fluid beds. One remedy for this fragility is to increase the diameters of the channels in the vent channel array patterns—channel diameters of upwards of 0.25 inch are not uncommon. However, this solution increases costs in terms of materials and in terms of labor associated with the retooling required for removal of artifacts caused by the large diameter vent channels on the surface of the finished casting.

Furthermore, even if the vent channel array patterns escape damage in the mold making process, successful venting during metal casting is not guaranteed. This is because the path by which molten metal fills the mold cavity is very unpredictable, and molten metal may enter and block a vent channel before gasses in sections of the mold have been adequately exhausted. In such a case, the fill-out problem will not have been solved.

Other problems associated with this traditional venting technique are the result of the fact that the vent channels in the mold walls ultimately are open to the atmosphere. For instance, a vent channel may not shut-off once gasses in the area being vented by that vent channel are evacuated. This shut-off failure can cause indentations and other defects on the surface of the cast metal object or even loss of the casting. In addition, dirt or other foreign matter may enter the mold cavity through the vent channels, fouling the casting.

It would be desirable to provide a venting mechanism which ensures that mold cavities sufficiently fill out with molten metal in heavily detailed sections and in sections having large surface areas relative to volume, thereby providing greater detail and more faithful reproduction in the finished cast object.

It would also be desirable to provide a venting mechanism which does not rely on use of patterns of interconnected vent channel arrays, thus minimizing pattern fragility and simplifying the mold making process.

It would further be desirable to provide a venting mechanism which provides adequate ventilation while minimizing the amount of retooling of the surface of the cast metal object that is necessary.

It would still further be desirable to provide a venting mechanism which minimizes the possibility of molten metal entering a vent before the gasses being exhausted by that vent have been adequately removed.

It would yet further be desirable to provide a venting mechanism which provides adequate ventilation while minimizing drainage of molten metal from the mold cavity.

It would yet further be desirable to provide a venting mechanism which provides adequate ventilation while minimizing the chances for introduction of dirt or other foreign matter into the mold cavity.

SUMMARY OF THE INVENTION

It is an object of the present invention to provide a venting mechanism which ensures that mold cavities sufficiently fill out with molten metal in heavily detailed sections and in sections having large surface areas relative co volume, thereby providing greater detail and more faithful reproduction in the finished cast object.

It is also an object of this invention to provide a venting mechanism which does not rely on use of patterns of interconnected vent channel arrays, thus minimizing pattern fragility and simplifying the mold making process.

It is a further object of this invention to provide a venting mechanism which provides adequate ventilation while minimizing the amount of retooling of the surface of the cast metal object that is necessary.

It is a still further object of this invention to provide a venting mechanism which minimizes the possibility of molten metal entering a vent before the gasses being exhausted by that vent have been adequately removed.

It is yet a further object of this invention to provide a venting mechanism which provides adequate ventilation while minimizing drainage of molten metal from the mold cavity.

It is yet a further object of this invention to provide a venting mechanism which provides adequate ventilation while minimizing the chances for introduction of dirt or other foreign matter into the mold cavity.

In accordance with this invention, there is provided a vent-forming apparatus which is used in the mold making process in order to create vents in the mold walls.

The vent-forming apparatus according to this invention comprises a small-diameter (e.g., about 0.1 inch to about 0.15 inch) lead-in tube, a breather tube and a gas-permeable membrane.

The lead-in and breather tubes should preferably be solid and should preferably be made of wax, plastic or other soluble, fusible or combustible material and combinations thereof that will dissolve, melt or burn away during the dewax and burn-out cycle without leaving behind substantial amounts of ash. The lead-in and breather tubes can be hollow, but, at minimum, one end of the breather tube should be closed in order to prevent the mold making material or other foreign matter from entering the breather tube during the mold making process.

The gas-permeable membrane should be made of a material through which gasses pass easily, but which will not pass liquids, molten metal or foreign matter such as dirt or stucco. The gas-permeable membrane also should be able to withstand the temperatures encountered during the casting of molten metal. Suitable materials for the gas-permeable membrane include refractory paper, refractory filter material, or any other material that is gas-permeable and capable of withstanding the temperatures encountered during the casting of molten metal.

It also is desirable for the gas-permeable membrane to be coated with a sealing material that will prevent slurry penetration of the gas-permeable membrane during the mold making process. The sealing material must be capable of being dissolved, melted or burned away during the dewax and burn-out cycle without leaving behind substantial amounts of ash. Suitable sealing materials include wax, plastic or other soluble, fusible or combustible material and combinations thereof. Furthermore, upon completion of the dewax and burn-out cycle, a margin remains around the perimeter of the gas-permeable membrane where the coating material had been. This margin aids in the venting of gases from the mold cavity be increasing the vent area thereby preventing the build up of back-pressure.

If the gas-permeable membrane is not coated, the lead-in tube connects at one of its ends to a surface of the gas-permeable membrane. The breather tube connects at one of its ends to the opposite surface of the gas-permeable membrane. If the breather tube is hollow and has only one closed end, i.e., it has one open end, then the breather tube connects to the gas-permeable membrane at its open end.

If the gas-permeable membrane is coated, the lead-in tube connects at one of its ends to a coated surface of the coated gas-permeable membrane and the breather tube connects at one of its ends to the opposite coated surface of the coated gas-permeable membrane. If the breather tube is hollow and has only one closed end, i.e., it has one open end, then the breather tube connects to the coated surface of the coated gas-permeable membrane at its open end.

Vent-forming apparatus according to this invention are attached independently, as part of the mold making process, to desired areas of a pattern of the object to be cast in metal. This attachment occurs at the free end of the lead-in tube—i.e., the end not attached to the gas-permeable membrane. The mold walls are constructed around the pattern of the object to be cast, the vent-forming apparatuses, and the patterns of any ingates, pouring basins, down sprues or runners. During the dewax and burn-out cycle, the pattern, lead-in tubes, breather tubes and any materials coating the gas-permeable membranes are removed. The resulting mold walls are infiltrated with independent vents which will exhaust gasses from the mold cavity to the atmosphere during casting. The gas-permeable membrane remains in and substantially spans each vent.

The gas-permeable membrane remaining in each vent passes only gasses, so when gasses in a vented area are exhausted, and replaced by molten metal, the vent in that area shuts off and will not drain the molten metal.

The presence of a gas-permeable membrane in each vent also minimizes the possibility of dirt or other foreign matter entering the mold cavity through the vent. Dirt or other foreign matter would be blocked from entering the mold cavity by the gas-permeable membrane.

Because the vent-forming apparatuses according to this invention are independent and not interconnected, they may be easily located on any desired section of the pattern of the object to be cast in metal. Their independence also minimizes the fragility problems associated with the previously known technique described above.

Additionally, because the diameters of the vents in the mold walls are so small, molten metal flowing into the mold cavity solidifies almost immediately upon reaching an area in which the gasses have been exhausted by a given vent. Accordingly, only a small amount of molten metal may enter a vent, resulting at most in a small metal tube on the surface of the cast metal object. Such a small metal tube is easily removed during the finishing process resulting in an associated reduction in labor costs associated with surface retooling.

Thus, by using vent-forming apparatuses according to this invention, venting of the mold cavity can be neat, precise and confined to local areas in need of venting.

In another embodiment, either or both of the lead-in and breather tubes may be made of ceramic, plaster, other non-combustible materials and combinations thereof. In such case, the ceramic, plastic or other non-combustible material remains in the mold walls at the conclusion of the dewax and burn-out cycle. Lead-in and breather tubes made of ceramic, plastic or other non-combustible material should be hollow.

At minimum, one end of the breather tube made of ceramic, plaster, other non-combustible material and combinations thereof should be closed with a material such as wax, plastic or other soluble, fusible or combustible material that will dissolve, melt or burn away during the dewax and burn-out cycle without leaving behind substantial amounts of ash. One end of the breather tube is closed as described above to prevent the mold making material or other foreign matter from entering the breather tube during the mold making process.

If the gas-permeable membrane is coated as described above, the breather tube connects to the coated surface of the coated gas-permeable membrane at its open end. If the gas-permeable membrane is not coated as described above, then the breather tube connects to the gas-permeable membrane at its open end.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout, and in which.

DETAILED DESCRIPTION OF THE INVENTION

Figure 1:
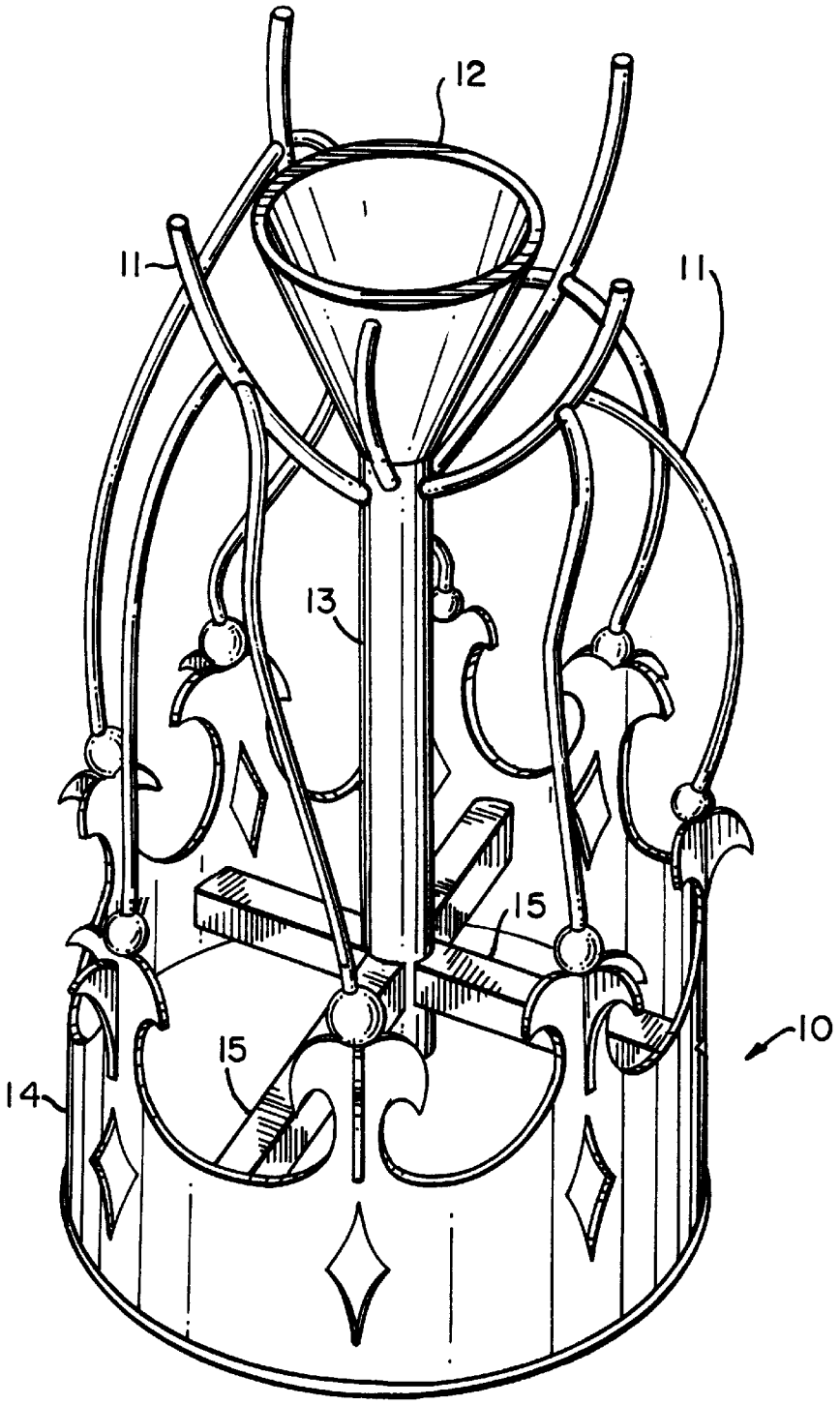
FIG. 1 PRIOR ART
FIG. 1 is a perspective view of a pattern of an object to be cast in metal with an attached pattern of a prior art vent channel array.

As explained above, previously known methods of venting often employ arrays of interconnected vent channels infiltrating the mold walls. These vent channel arrays are created in the mold walls during construction of the mold. With reference to FIG. 1 which represents this previously known technique, a pattern of the vent channel array 11, a pattern of the object 14 to be cast in metal, a pattern of a pouring basin 12, a pattern of a down sprue 13 and patterns of ingates 15 are fashioned in wax, plastic or other soluble, fusible or combustible material. The pattern of the vent channel array 11 is attached in desired areas to the pattern 14 of the object to be cast in metal, and to the patterns of the down sprue 13, pouring basin 12 and ingates 15. The resulting structure 10 is coated with layers of ceramic slurry and stucco in order to construct the mold. The dewax and burn-out cycle yields a shell-type mold having walls infiltrated with an interconnected array of vent channels.

A major problem associated with this known venting technique is the fragility of the patterns of the vent channel arrays 11. Patterns of the vent channel arrays 11 also can be expensive to make depending on their complexity. Because the molds are generally used only once, the expense associated with this venting technique is compounded.

Use in the mold making process of vent-forming apparatuses according to this invention does not suffer such fragility problems and is more economical because each vent-forming apparatus is independent of the others. Moreover, all vent-forming apparatuses are substantially identical, except possibly for size, meaning that economies of scale can be enjoyed in the mass production of vent-forming apparatuses even if it is necessary to produce several different sizes of vent-forming apparatuses.

Figure 2:
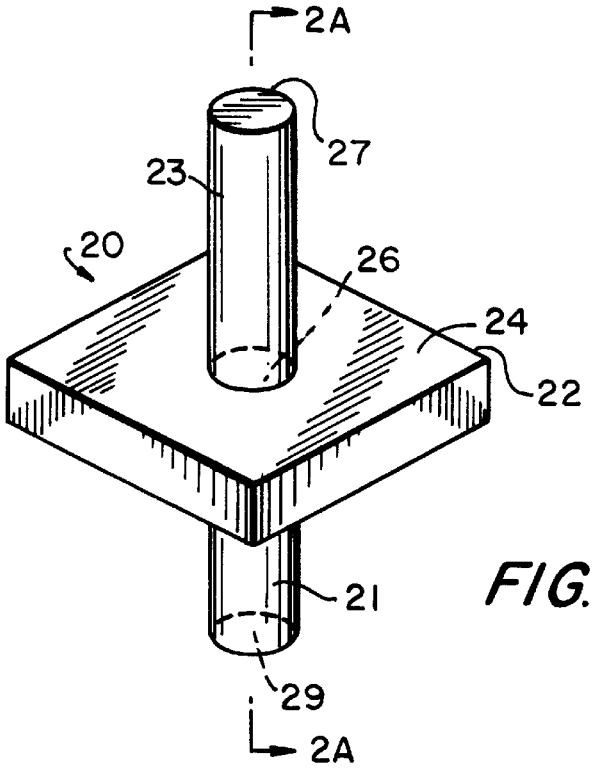
FIG. 2 is a perspective view of a vent-forming apparatus according to this invention.
Figure 2A:
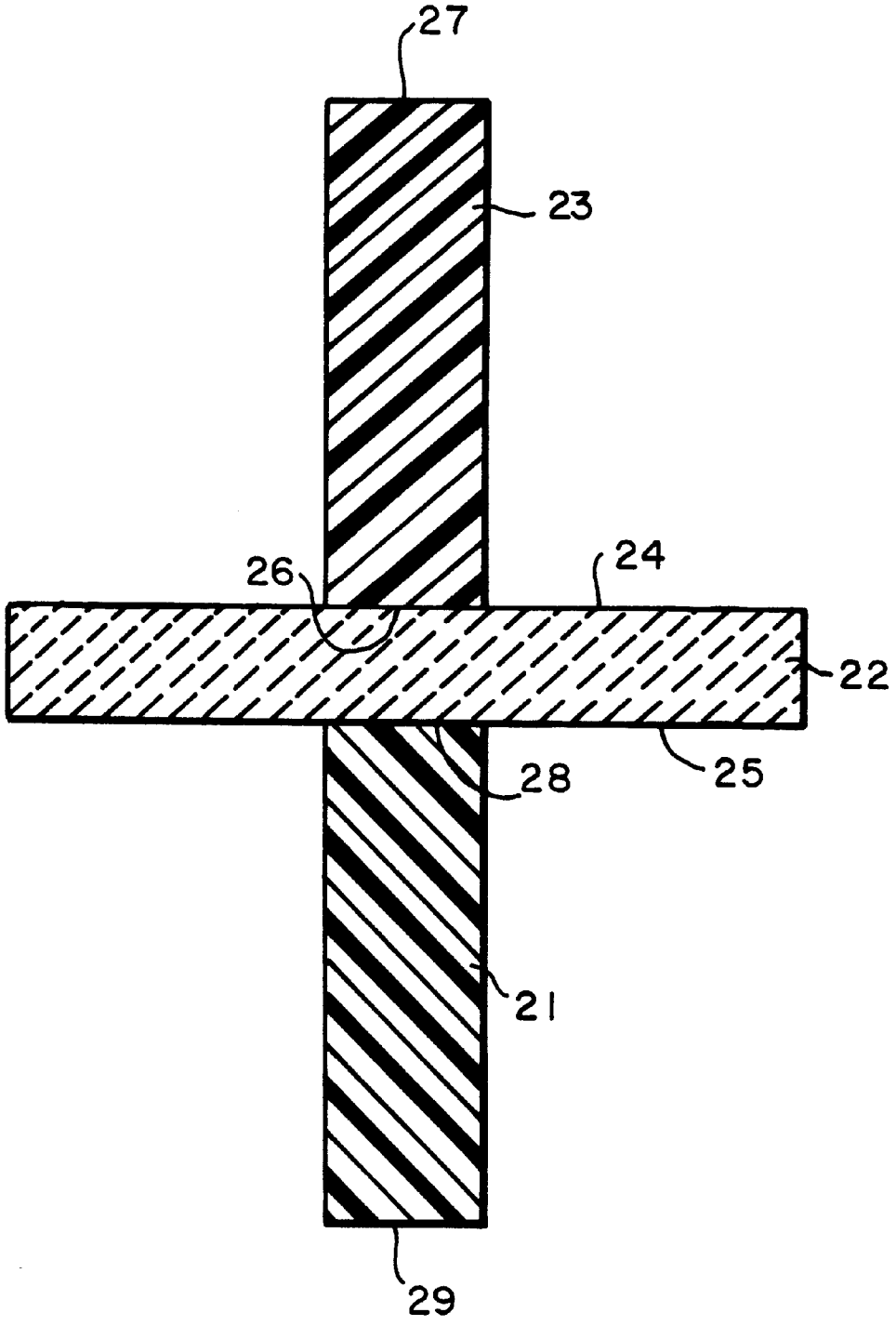
FIG. 2A is a cross-sectional view of a vent-forming apparatus according to this invention taken along line 2A of FIG. 2.
Figure 2B:
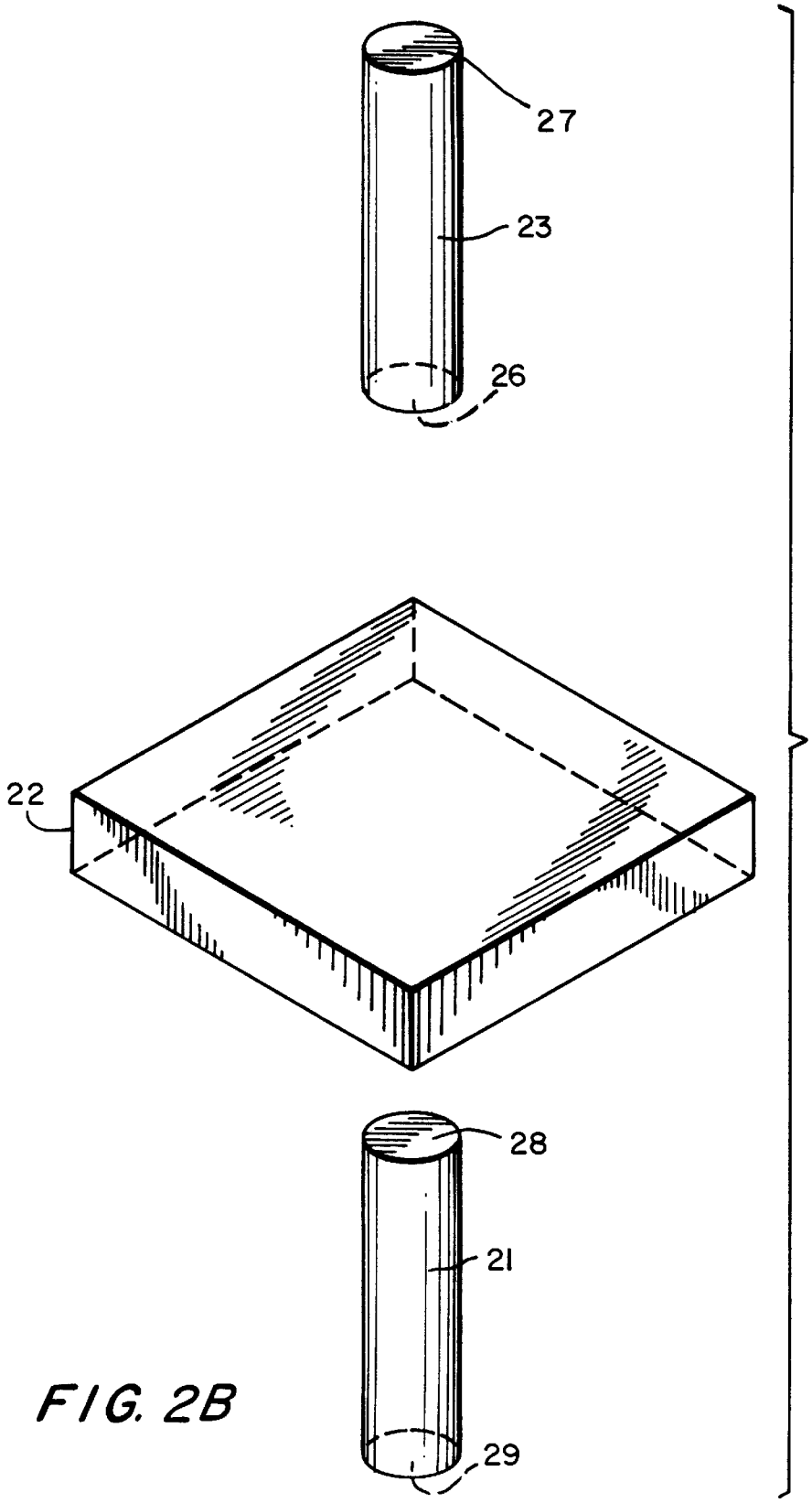
FIG. 2B is an exploded perspective view of a vent-forming apparatus according to this invention.

With reference to FIG. 2, FIG. 2A and FIG. 2B, vent-forming apparatus 20 according to this invention has a lead-in 20 tube 21, a gas-permeable membrane 22 and a breather tube 23. The lead-in tube 21 has a membrane connection end 28 and a free end 29. The breather tube 23 has a membrane connection end 26 and a free end 27. For purposes of illustration, the lead-in tube 21 and the breather tube 23 are shown as cylindrical in shape. However, it is not necessary that the lead-in tube or the breather tube be of any particular geometric shape.

The lead-in tube 21 and the breather tube 23 preferably are solid and preferably are made of materials that can be dissolved, melted or burned away during the dewax and burn-out cycle without leaving behind substantial amounts of ash. Suitable materials include wax, plastic, and other soluble, fusible or combustible materials and combinations thereof. The lead-in tube 21 and breather tube 23 can be hollow, but the free end 27 of breather tube 23 should be closed in order to prevent mold making material or other foreign matter from entering the breather tube during the mold making process. Suitable materials for closing the free end 27 of breather tube 23 include wax, plastic, and other soluble, fusible or combustible materials and combinations thereof.

The diameters of the lead-in tube 21 and breather tube 23 preferably are between about 0.1 inch and about 0.15 inch, but can be larger or smaller as desired depending on the features of areas of the mold cavity to be vented. It is not required that the diameters of the lead-in tube 21 and breather tube 23 be the same. However, if the diameter of the breather tube 23 is substantially different than the diameter of the lead-in tube 21, it is conceivable that during casting, the gas-permeable membrane 22 could become dislodged or bowed as a result of a pressure differential resulting from the difference in tube diameters.

The gas-permeable membrane 22 has two opposite surfaces—an atmospheric surface 24 and a mold cavity surface 25. For purposes of illustration, the gas-permeable membrane 22 is shown to be square in shape. However, it is not necessary for the gas-permeable membrane to be of any particular shape. The lead-in tube 21 preferably connects at its membrane connection end 28 to the mold cavity surface 25 of the gas-permeable membrane 22. The breather tube 23 preferably connects at its membrane connection end 26 to the atmospheric surface 24 of the gas-permeable membrane 22. The lead-in tube 21 and the breather tube 23 preferably should be positioned with respect to the gas-permeable membrane 22 such that if gas-permeable membrane 22 were not present, their respective membrane connection ends 28 and 26 would exhibit some degree of concentricity with regard to one another. Neither perfect nor substantial concentricity is required. Precision is not of importance in this regard.

The gas-permeable membrane 22 preferably should be made of a material through which gasses pass easily, but which preferably will not pass liquids, molten metal or foreign matter such as dirt or stucco. The gas-permeable membrane 22 also must be able to withstand the temperatures encountered during the casting of molten metal. Suitable materials for the gas-permeable membrane 22 include refractory paper, refractory filter material, or any other material that is gas-permeable and capable of withstanding the temperatures encountered during the casting of molten metal.

The area of the gas-permeable membrane 22 is some multiple of the cross-sectional area of the membrane connection end 28 of the lead-in tube 21. This multiple is preferably greater than one, but it also can be less than one. The magnitude of this multiple is dependent on the degree of gas-permeability of the material used as the gas-permeable membrane 22. Generally speaking, the greater the degree of gas-permeability of the membrane material, the smaller the multiple. In practice, the multiple is generally on the order of between about 5 and about 25.

The desired degree of gas-permeability of the material employed as the gas-permeable membrane 22 is dependent on the alloy being cast. In the case of alloys having higher melting temperatures, such as steel, materials having greater refractory properties and a lesser degree of gas-permeability might be used as the gas-permeable membrane 22. As a result, the multiple would be on the higher end of the range and could even be greater than 25. When materials having greater gas permeability are used as the gas-permeable membrane 22, the multiple would be on the lower side of the range and could even be less than 5.

In most cases the same gas-permeable membrane material can be used for both low-melting point and high-melting point alloys. This is because the diameters of the lead-in tubes 21 are so small. As a result, the vent diameters in the finished mold walls are small. Because the vents have such small diameter, molten metal solidifies almost immediately upon reaching a vent after the gasses have been exhausted from the area of the mold cavity being vented by a particular vent. Therefore, the refractory quality of the gas-permeable membrane 22 that is needed for low-melting point and high-melting point alloys is, in practice, about the same.

In manufacture of vent-forming apparatus 20, it is desirable that the gas-permeable membrane 22 be substantially coated with a material that substantially seals the gas-permeable membrane 22 so as to substantially prevent saturation and subsequent closing of the pores of the gas-permeable membrane 22 by liquid slurry during the mold making process. Substantial slurry penetration of the gas-permeable membrane 22 could destroy the gas-permeability of the membrane 22. The coating should be a material that will dissolve, melt or burn away during the dewax and burn-out cycle without leaving behind substantial amounts of ash. The coating as applied to the gas-permeable membrane 22 also should be thin enough so that when it is removed during the dewax and burn-out cycle, it does not leave an open margin around the gas-permeable membrane 22 that will pass molten metal.

If gas-permeable membrane 22 is substantially coated, then membrane connection end 28 of lead-in tube 21 and membrane connection end 26 of breather tube 23 respectively attach to the substantially coated mold-cavity surface 25 and substantially coated atmospheric surface 24 of gas-permeable membrane 22. Materials suitable for the coating material can serve as the mechanism for attaching the membrane connection end 28 of lead-in tube 21 and the membrane connection end 26 of breather tube 23 to the substantially coated gas-permeable membrane 22. Suitable coating materials include wax, plastic, other soluble, fusible or combustible materials and combinations thereof.

Figure 3:
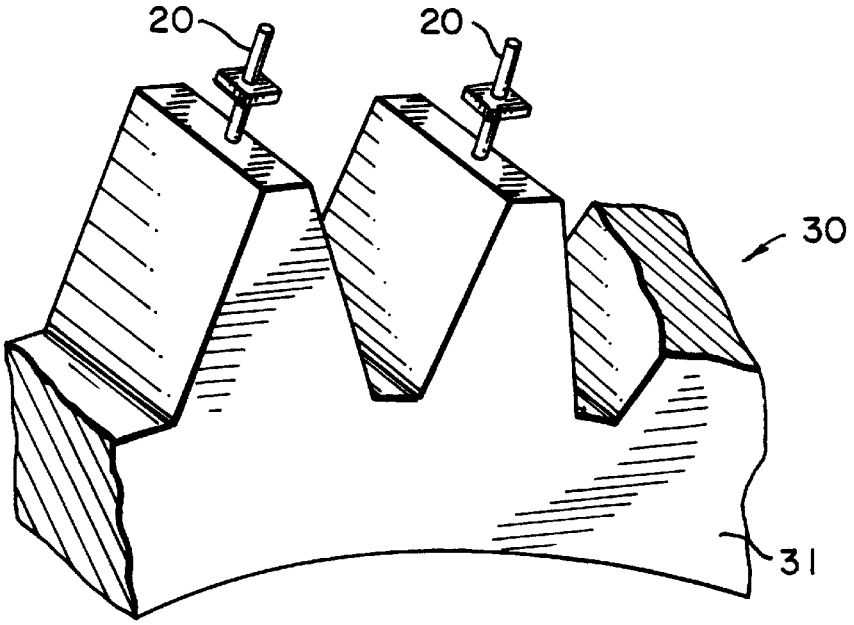
FIG. 3 is a fragmentary perspective view of vent-forming apparatus according to this invention attached to a pattern of an object to be cast in metal.

With reference to FIG. 3, in use, vent-forming apparatuses 20 according to this invention are substantially attached at the free end 29 of lead-in tube 21 to desired areas of the pattern 31 of the object to be cast in metal. This substantial attachment can be achieved using materials that can be dissolved, melted or burned away during the dewax and burn-out cycle. Suitable materials include wax, plastic, other soluble, fusible or combustible materials and combinations thereof. Layers of ceramic slurry and stucco are applied to the resulting structure 30 in order to construct a mold.

Figure 4:
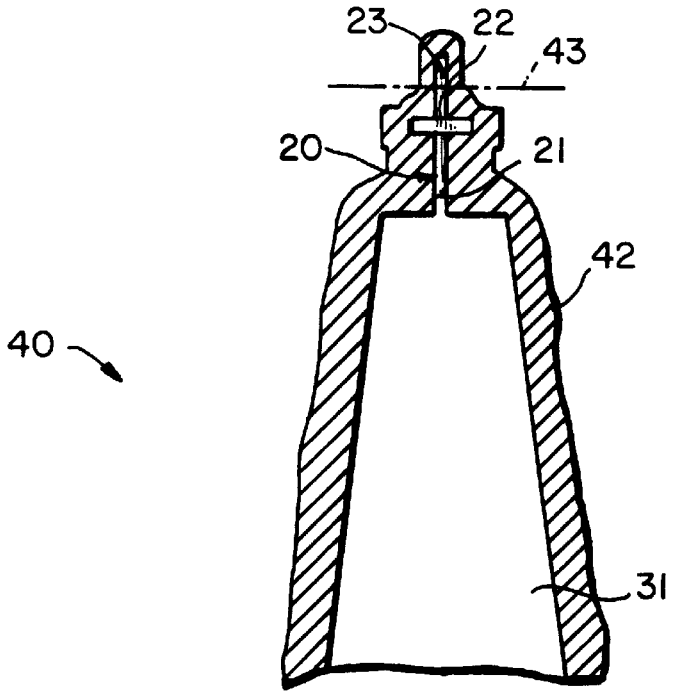
FIG. 4 is a cross-sectional view of a vent-forming apparatus according to this invention attached to a pattern of an object to be cast in metal and incorporated into a mold wall.

The result is shown in FIG. 4 where the mold wall 42 is shown surrounding the pattern 31 of the object to be cast in metal and the vent-forming apparatus 20. Once the mold 40 is constructed, the dewax and burn-out cycle can be completed so as to remove the pattern 31 of the object to be cast in metal, the lead-in tube 21, the breather tube 23 and any material coating the gas permeable membrane 22.

The breather tube 23 can be exposed to the atmosphere by grinding, cutting or nipping off the mold wall and a portion of breather tube 23, such as along cut-line 43, prior to the dewax and burn-out cycle. It also is possible to remove the desired portion of the mold wall after the dewax and burn-out cycle is completed. In either case, at completion of the dewax and burn-out cycle and after the desired portion of the mold wall has been removed, a vent is opened to the atmosphere. However, it generally is more efficient to cut the mold walls before the dewax and burn-out cycle because the melted, dissolved or burned materials can run out of the openings.

Figure 5:
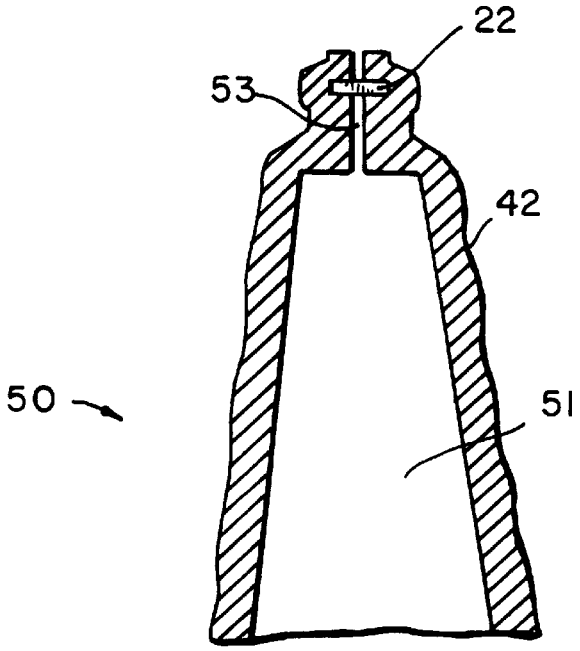
FIG. 5 is a cross-sectional view, of a finished mold made using a vent-forming apparatus according to this invention.

As seen in FIG. 5, the finished mold 50 has a mold cavity 51 in the form of the object to be cast in metal. The mold walls 42 are infiltrated with independent vents 53 that exhaust gasses from the mold cavity 51 to the atmosphere. Each vent 53 is formed as a result of the removal of the lead-in tube 21, the breather tube 23 and any material coating the gas-permeable membrane 22 during the dewax and burn-out cycle. The gas-permeable membrane 22 remains in and substantially spans each vent 53.

Figure 6:
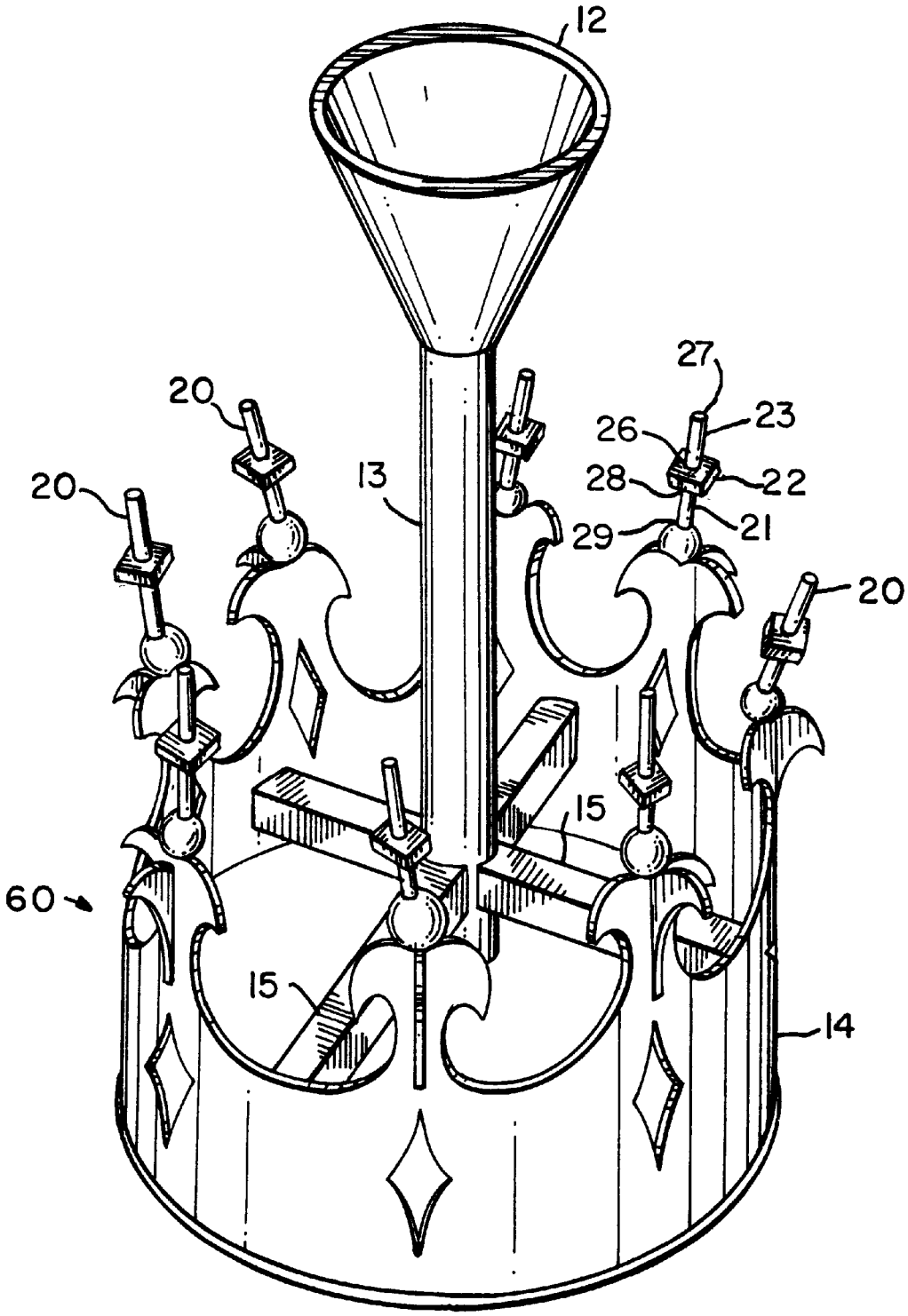
FIG. 6 is a perspective view of vent-forming apparatus according to this invention attached to a pattern of an object to be cast in metal.

An advantage associated with vent-forming apparatuses 20 according to this invention derives from the fact that the vent-forming apparatuses 20 can be used independently as shown in FIG. 6. With reference to FIG. 6, this independence substantially eases the effort required in placing the vent-forming apparatuses 20 on the pattern 60 of the object to be cast in metal 14. Because the vent-forming apparatuses 20 according to this invention are independent and not interconnected, they may be easily located on any desired section of the pattern of the object to be cast in metal 14. The independent vent-forming apparatuses 20 also are far less fragile in use than the previously known vent channel array patterns 11 shown in FIG. 1. This apparatus independence results in labor and materials savings as compared to the previously known venting technique described above.

Other advantages associated with use of vent-forming apparatuses 20 according to this invention relate to the function of the gas-permeable membrane 22. With reference to FIG. 5, the gas-permeable membrane 22 remaining in each vent 53 passes only gasses, so when gasses in a vented area of the mold cavity 51 are exhausted, and replaced by molten metal, the vent in that area shuts off and will not drain molten metal.

Presence of the gas-permeable membrane 22 in each vent 53 also minimizes the possibility of dirt or other foreign matter entering the mold cavity 51 through the vent 53. Dirt or other foreign matter would be blocked from entering the mold cavity 51 by the gas-permeable membrane 22.

Another advantage of vent-forming apparatuses 20 according to this invention is associated with the small diameters of the lead-in tubes 21. Because the lead-in tubes 21 have such small diameters, they yield small diameter vents 53 in the mold walls 42. Because of these small diameters, molten metal flowing into the mold cavity 51 solidifies almost immediately upon reaching an area in which the gasses have been exhausted by a given vent. Accordingly, any surface artifacts remaining in the cast object as a result of the small diameter vents 53 are so small that they are easily removed from the surface of the finished cast object. Thus, there is an associated reduction in labor costs associated with surface retooling.

Thus, by using vent-forming apparatuses 20 according to this invention, venting of the mold cavity 51 can be neat, precise and confined to local areas in need of venting.

In another embodiment, either or both of the lead-in tube 21 and the breather tube 23 may be made of ceramic, plaster, other non-combustible materials and combinations thereof. In such case, lead-in tubes 21 and breather tubes 23 made of ceramic, plaster, other non-combustible materials and combinations thereof should be hollow. The free end 27 of breather tube 23 should be closed or otherwise capped with a material such as wax, plastic or other soluble, fusible or combustible material and combinations thereof that will dissolve, melt or burn away during the dewax and burn-out cycle without leaving behind substantial amounts of ash. The free end 27 of breather tube 23 should be closed in order to prevent mold making material or other foreign matter from entering the breather tube during the mold making process.

The vent-forming apparatus 20 according to this invention also can be used in solid mold investment casting methods or in any other casting method in which venting is desirable or necessary. Solid mold investment casting methods are similar to the ceramic shell casting method, but instead involve the making of molds from materials such as gypsum and stucco or calcium aluminate and stucco.

Thus it is seen that a vent-forming apparatus for metal casting and method of use are provided. The vent-forming apparatus according to this invention provides a mechanism for ensuring that mold cavities sufficiently fill out with molten metal; does not rely on use of patterns of interconnected vent channel arrays thus minimizing fragility and simplifying the mold making process; minimizes the amount of necessary retooling of the surface of the cast metal object; minimizes the possibility of molten metal entering a vent before gasses being exhausted by that vent have been adequately removed; minimizes drainage of molten metal from the mold cavity; and minimizes the chances for introduction of dirt or other foreign matter into the mold cavity. One skilled in the art will appreciate that the present invention can be practiced by other than the described embodiments, which are presented for purposes of illustration and not of limitation, and the present invention is limited only by the claims which follow.

What is claimed is:

1. A vent-forming apparatus for making a gas vent in a wall of a mold for casting metal, said vent-forming apparatus comprising:

(a) a gas-permeable, liquid-impermeable membrane having an atmosphere facing surface and an opposing mold cavity facing surface;

(b) a lead-in tube having a free end and an opposing membrane connection end, said membrane connection end of said lead-in tube being in substantial contact with said mold cavity facing surface of said gas-permeable, liquid-impermeable membrane, and said free end being connectable to the mold cavity and allowing for the passage of gas into said lead-in tube; and c) a breather tube having a free end and an opposing membrane connection end, said membrane connection end of said breather tube being in substantial contact with said atmosphere facing surface of said gas-permeable, liquid-impermeable membrane.

2. The vent-forming apparatus of claim 1, wherein:

(a) said gas-permeable, liquid-impermeable membrane comprises a gas-permeable, liquid-impermeable material capable of withstanding temperatures associated with casting of molten metal;

(b) said lead-in tube comprises a tube made of a material capable of melting, dissolving or burning without leaving behind substantial amounts of ash; and (c) said breather tube comprises a tube made of a material capable of melting, dissolving or burning without leaving behind substantial amounts of ash.

3. The vent-forming apparatus of claim 2 wherein:

(a) said gas-permeable, liquid-impermeable material capable of withstanding temperatures associated with casting of molten metal comprises a material selected from the group consisting of refractory paper and refractory filter material; and (b) said material capable of melting, dissolving or burning without leaving behind substantial amounts of ash comprises a material selected from the group consisting of wax, plastic, soluble material, fusible material, combustible material and combinations thereof.

4. The vent-forming apparatus of claim 1 wherein:

(a) said membrane connection end of said lead-in tube is substantially attached to said mold cavity surface of said gas-permeable, liquid-impermeable membrane; and (b) said membrane connection end of said breather tube is substantially attached to said atmospheric surface of said gas-permeable, liquid-impermeable membrane.

5. The vent-forming apparatus of claim 4 wherein said membrane connection end of said lead-in tube is substantially attached to said mold cavity surface of said gas-permeable, liquid-impermeable membrane with a material selected from the group consisting of wax, plastic, soluble material, fusible material, combustible material and combinations thereof.

6. The vent-forming apparatus of claim 4 wherein said membrane connection end of said breather tube is substantially attached to said atmospheric surface of said gas-permeable, liquid-impermeable membrane with a material selected from the group consisting of wax, plastic, soluble material, fusible material, combustible material and combinations thereof.

7. The vent-forming apparatus of claim 2 wherein said gas-permeable, liquid-impermeable membrane is substantially coated with a material capable of melting, dissolving or burning without leaving behind substantial amounts of ash so as to substantially seal said gas-permeable, liquid-impermeable membrane.

8. The vent-forming apparatus of claim 7 wherein said material capable of melting, dissolving or burning without leaving behind substantial amounts of ash comprises a material selected from the group consisting of wax, plastic, soluble material, fusible material, combustible material and combinations thereof.

9. The vent-forming apparatus of claim 7 wherein:

(a) said membrane connection end of said lead-in tube is substantially attached to said substantially coated mold cavity surface of said gas-permeable, liquid-impermeable membrane; and (b) said membrane connection end of said breather tube is substantially attached to said substantially coated atmospheric surface of said gas-permeable, liquid-impermeable membrane.

10. The vent-forming apparatus of claim 9 wherein said membrane connection end of said lead-in tube is substantially attached to said substantially coated mold cavity surface of said gas-permeable, liquid-impermeable membrane with a material selected from the group consisting of wax, plastic, soluble material, fusible material, combustible material and combinations thereof.

11. The vent-forming apparatus of claim 9 wherein said membrane connection end of said breather tube is substantially attached to said substantially coated atmospheric surface of said gas-permeable, liquid-impermeable membrane with a material selected from the group consisting of wax, plastic, soluble material, fusible material, combustible material and combinations thereof.

12. The vent-forming apparatus of claim 1 wherein said lead-in tube has a diameter between about 0.1 inch and about 0.15 inch.

13. The vent-forming apparatus of claim 1 wherein said breather tube has a diameter between about 0.1 inch and about 0.15 inch.

14. The vent-forming apparatus of claim 1 wherein said lead-in tube comprises a hollow tube made of a material selected from the group consisting of ceramic, plaster, other non-combustible materials and combinations thereof.

15. The vent-forming apparatus of claim 1 wherein said breather tube comprises a hollow tube made of a material selected from the group consisting of ceramic, plaster, other non-combustible materials and combinations thereof.

16. The vent-forming apparatus of claim 15 wherein said free end of said breather tube is substantially closed.

17. The vent-forming apparatus of claim 16 wherein said free end of said breather tube is substantially closed with a material capable of melting, dissolving or burning without leaving behind substantial amounts of ash.

18. The vent-forming apparatus of claim 17 wherein said material capable of melting, dissolving or burning without leaving behind substantial amounts of ash comprises a material selected from the group consisting of wax, plastic, soluble material, fusible material, combustible material and combinations thereof.

19. The vent-forming apparatus of claim 1 wherein said lead-in tube comprises a hollow tube.

20. The vent-forming apparatus of claim 1 wherein said breather tube comprises a hollow tube.

21. The vent-forming apparatus of claim 20 wherein said free end of said breather tube is substantially closed.

22. The vent-forming apparatus of claim 21 wherein said free end of said breather tube is substantially closed with a material capable of melting, dissolving or burning without leaving behind substantial amounts of ash.

23. The vent-forming apparatus of claim 22 wherein said material capable of melting, dissolving or burning without leaving behind substantial amounts of ash comprises a material selected from the group consisting of wax, plastic, soluble material, fusible material, combustible material and combinations thereof.

24. The vent-forming apparatus of claim 1 wherein:

(a) said gas-permeable, liquid-impermeable membrane has an area;

(b) said membrane connection end of said lead-in tube has an area; and (c) said area of said gas-permeable, liquid-impermeable membrane is a multiple of said area of said membrane connection end of said lead-in tube.

25. The vent-forming apparatus of claim 24 wherein said area of said gas-permeable, liquid-impermeable membrane is less than said area of said membrane connection end of said lead-in tube.

26. The vent-forming apparatus of claim 24 wherein said area of said gas-permeable, liquid-impermeable membrane is greater than said area of said membrane connection end of said lead-in tube.

27. The vent-forming apparatus of claim 24 wherein said area of said gas-permeable, liquid-impermeable membrane is between about 5 times and about 25 times said area of said membrane connection end of said lead-in tube.

28. The vent-forming apparatus-forming apparatus of claim 1 wherein said free end of said lead-in tube is formed to substantially inhibit the flow of liquid into said lead-in tube.

* * * * *